US005872560A

United States Patent [19]

Droege et al.

[11] Patent Number: 5,872,560

[45] Date of Patent: Feb. 16, 1999

[54] INTRUSION DETECTION SECURITY KEYBOARD

[75] Inventors: Hartmut Droege, Stuttgart; Ludwig Fischer, Herrenberg; Markus Scheibel, Blaufelden; Dieter Sonnentag, Schoenaich, all of Germany

[73] Assignee: International Business Machines Corporation, Armonk, N.Y.

[21] Appl. No.: 782,466

[22] Filed: Jan. 10, 1997

[30] Foreign Application Priority Data

Jan. 11, 1996 [DE] Germany ..... 196 00 768.2

[51] Int. Cl.[6] ..... G09G 5/00

[52] U.S. Cl. ..... 345/168; 345/170; 345/172

[58] Field of Search ..... 345/168, 170, 345/171, 172; 178/18.03, 19.06; 341/22, 34; 200/510, 511, 512, 515, 517, 521

[56] References Cited

U.S. PATENT DOCUMENTS

| | | | |
|---|---|---|---|
| 4,017,700 | 4/1977 | West | 200/521 |
| 4,034,177 | 7/1977 | Sims, Jr. | 200/521 |
| 4,962,530 | 10/1990 | Cairns | 345/170 |
| 5,057,657 | 10/1991 | Skulic | 200/517 |
| 5,228,561 | 7/1993 | Schroeder | 200/512 |
| 5,717,565 | 2/1998 | Raasch | 200/511 |

*Primary Examiner*—Vijay Shankar
*Attorney, Agent, or Firm*—Norman L. Gundel

[57] ABSTRACT

A security keyboard is disclosed with a contacting circuit board, a plurality of keys and a switching foil, where the contacting circuit board comprises contact elements necessary for the security keyboard and which is substantially completely enveloped in a security film and in operating the plurality of keys the keyboard pressure is transmitted through the security film to the contacts of the contacting circuit board. In accordance with the invention, the plurality of keys are held in the switching foil in such a way that on operating the plurality of keys a tactile feedback is produced. This permits a positive switching of the security keyboard since, because of the tactile feedback, an 'automatic' back-pressure of the keys results through a force inflection point, after which an operating force necessary for the operation of the keys, increases again as a consequence, in part, of the security film lying between the key and the contacting means of the security keyboard.

1 Claim, 2 Drawing Sheets

INTRUSION DETECTION SECURITY KEYBOARD

BACKGROUND OF THE INVENTION

1. Field of the Invention

The present invention relates to a security keyboard with contacting means, a plurality of keys and a switching foil, where the contacting means has contact elements required for the security keyboard and is substantially completely enclosed in a security film and the keyboard pressure on operating the plurality of keys is transmitted through the security film to the contact elements of the contacting means.

2. Description of the Related Art

At the present time a range of equipment is employed for electronic funds transfer (EFT or electronic cash) for data entry or output. Certain security provisions are associated with this equipment in order to be able to avoid any possible undesired manipulation. The security of confidential information and the protection of data input and output from possible influences or manipulation is generally effected by means of electronic or mechanical security measures, such as, for example, the physical incorporation of various security-relevant components into one security module. Particularly security-sensitive components or modules are, in particular, data displays for data output, data input keyboards, key memory for storing confidential keys, e.g. for coding data transfer and security circuits for electronic protection of security-relevant components. Thus, keyboards in particular, have to be protected against simultaneous disclosure of input data, such as a personal identification number (PIN).

A security module for an electronic funds transfer system is known from European Patent Application EP A-0186981. The security module is located in an impact-resistant housing. The module has a PIN entry block and can key confidential data, such as, for example, the PIN, and thus offers access to these data to other equipment.

An extensive study of the physical security of systems for an electronic funds transfer is known from the IBM document "Physical Security for the IBM Transaction Security System", IBM Charlotte, North Carolina, 28257, 6th May 1991 by G. P. Double. This document proposes various test methods and possible protective measures. In particular, this document teaches the use of a so-called Intrusion Detection Screen for the electronic detection of mechanical penetration of the film. The intrusion detection screen comprises a flexible circuit board with thin meandering conductor paths. If the conductor paths are short-circuited or destroyed by mechanical action, such as, for example, penetration or tearing, this will be recognized by one of the in-built security switches. A monitoring logic connected to the intrusion detection screen recognizes changes in the resistance network of the protective film and sets off a suitable alarm which can lead, for example, to the deletion of security-relevant data.

To make manipulations at keyboards, which are intended, for example, for use in electronic funds transfer, more difficult, a range of measures is known which will enhance data security. A known method for this is to encapsulate the electronics to be protected, including the keyboard.

Apart from the encapsulation method, it is also usual to embed the security logic with data memory and the keyboard required for data input, in a housing and to wrap the housing in a security film. The security film is here designed in such a way that removal of or damage to the security film will lead to a corresponding alarm.

Apart from the data memory, which contains any security-relevant data, the keyboard must be protected so as to prevent or make more difficult the unauthorized 'theft' of the information input, such as, for example, a personal identification number (PIN). Total encapsulation of the keyboard, however, is not possible, since the keyboard must be at least partially accessible for input.

An arrangement is known from the IBM Technical Disclosure Bulletin, Vol.33, No.9, February 1991, pp. 448–449, in which the contact portions of the keyboard are disposed within a region protected by a security film while the keys themselves remain outside the protected region and are thus accessible to the user. It is a problem with this arrangement, however, that the security film opposes the pressure from the keyboard keys, so that the keys require increased pressure. This can, however, place greater mechanical demands on the security film. With repeated operation of the keys, the effects of wear are so marked that the working life of the equipment may be severely reduced. Positive operation of the keyboard can frequently not be ensured because of the greater force required.

In order to be able to avoid the aforementioned disadvantage of the greater force required on the keys of the keyboard brought about by the security film, there are arrangements in which the switches within the security film are operated through an opening in the security film by means of a plastic plunger. FIG. 1 shows an arrangement of this type in accordance with the state of the art. Such a keyboard has a circuit board 1 and a key 2. The circuit board 1 contains the necessary electronics for the keyboard while the key 2 acts on the circuit board to produce the signals. The circuit board 1 is completely within a housing 3 and underneath a security film 4. The key 2 partly juts out above the housing 3 and is returned to a defined starting position by means of a return spring 5. Within the security film 4 there is an aperture 6 through which a plunger 7 from the key 2 can act on the circuit board 1. After operation of the key 2, the latter is returned by means of the return spring 5 to the starting position.

It is, however, a disadvantage of this arrangement that the security film must have a plurality of openings, one for each key. As a consequence, the degree of security is significantly reduced, since penetration is possible into the security region through the apertures 6. This again requires expensive security measures to minimize the danger of possible intrusion through the security film.

SUMMARY OF THE INVENTION

It is the object of the present invention to overcome the aforementioned disadvantages of the state of the art and to make possible a secure but inexpensive keyboard.

In accordance with the invention, in a security keyboard in accordance with the generic type, the plurality of key is accommodated in the switching foil in such a way that a so-called tactile feedback is obtained in operating the plurality of keys. This permits secure switching of the security keyboard since, as a result of the tactile feedback, an 'automatic back-pressure' of the keys through a force inflection point, after which the necessary operating force required for operating the keys again increases as a result of the security film lying between the key and the contact point of the security keyboard.

The invention finds application particularly in the field of electronic funds transfer.

DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative detailed embodiment and when read in conjunction with the accompanying drawings, wherein:

While the invention will be described in connection with a preferred embodiment, the description is not intended to limit the invention to that embodiment. On the contrary, the invention is intended to cover all alternatives, modifications and equivalents as may be included within the spirit and scope of the invention as described by the appended claims.

DETAILED DESCRIPTION OF THE INVENTION

Figure 1:
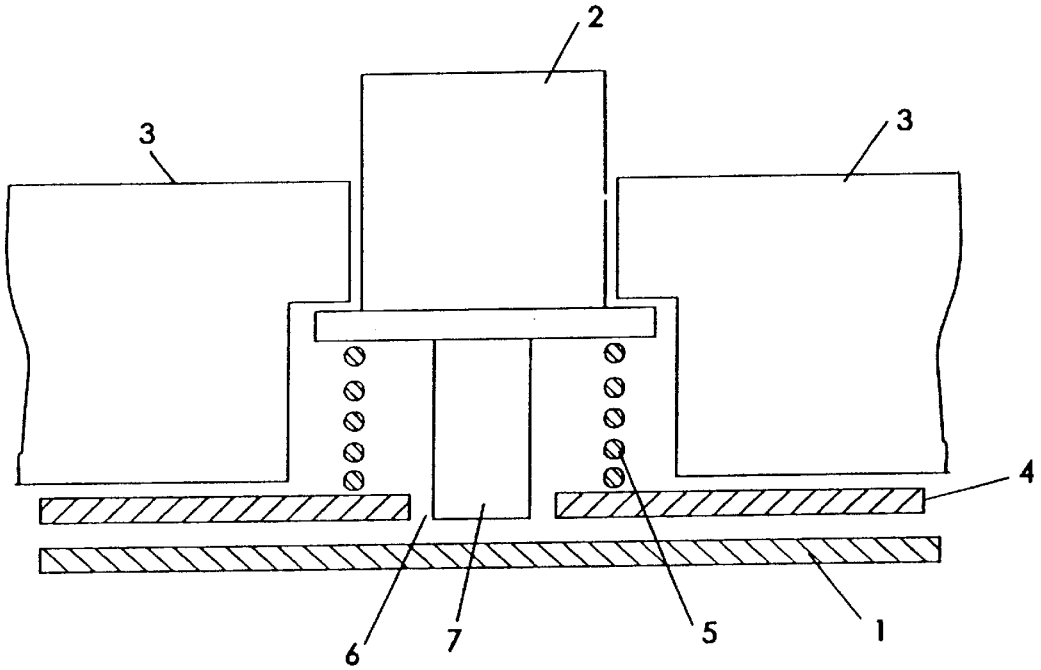
FIG. 1 depicts a prior art security keyboard.

With reference now to the Figures, and in particular with reference to FIG. 1, there is shown a prior art security keyboard having a circuit board 1 and a key 2. The circuit board 1 contains the necessary electronics for the keyboard while the key 2 acts on the circuit board to produce the signals. The circuit board 1 is completely within a housing 3 and underneath a security film 4. The key 2 partly juts out above the housing 3 and is returned to a defined starting position by means of a return spring 5. Within the security film 4 there is an aperture 6 through which a plunger 7 from the key 2 can act on the circuit board 1. After operation of the key 2, the latter is returned by means of the return spring 5 to the starting position.

Figure 2:
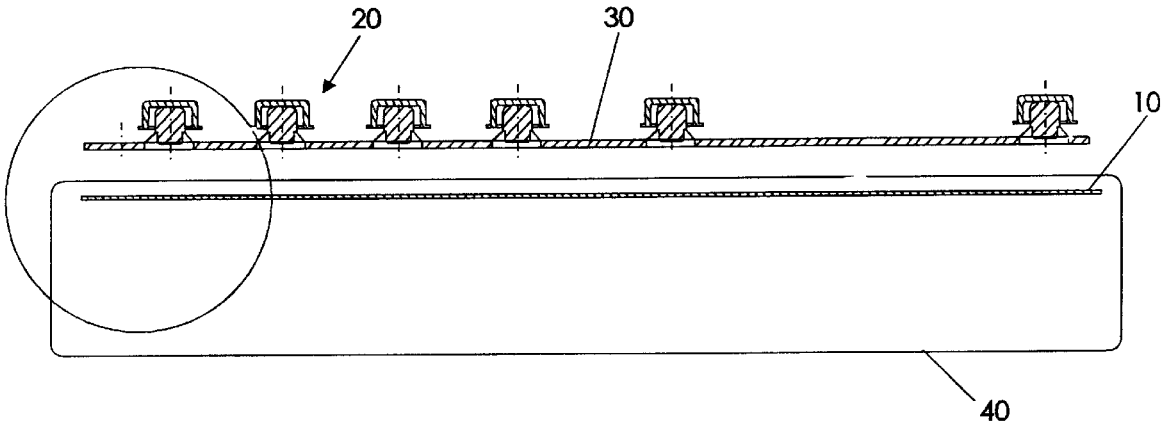
FIG. 2 shows the structure of a preferred embodiment of a security keyboard in accordance with the present invention.

FIG. 2 shows the structure of a preferred embodiment of a security keyboard in accordance with the present invention. The security keyboard includes a circuit board having contacting means 10, a plurality of keys 20 and a switching foil 30. The contacting means 10 contains the requisite contact elements for the security keyboard while the key 20 acts on the contacting means 10 to produce the switch signals in the contacting means 10. The contacting means 10 of the security keyboard is completely enveloped in a security film 40, which secures the contacting means 10 against unauthorized access. The contact elements of the security keyboard are connected to electronics (not shown) located within the security film wrap and create the desired electrical contact when a key 20 is operated.

The security film 40 may be any desired security film known in the state of the art, such as, for example, an above-mentioned intrusion detection screen with a meander-shaped resistance network. Unauthorized intrusion through the security film 40 can be recognized by a known security monitoring circuit (not shown) connected to the security film 40 and a suitable alarm signal can be actuated.

The security film 40 is preferably thin and elastic. In operating the key 20 the keyboard pressure is transferred through the elastic and preferably highly wear-resistant security film 40, directly to the contact elements of the contacting means 10.

Figure 3:
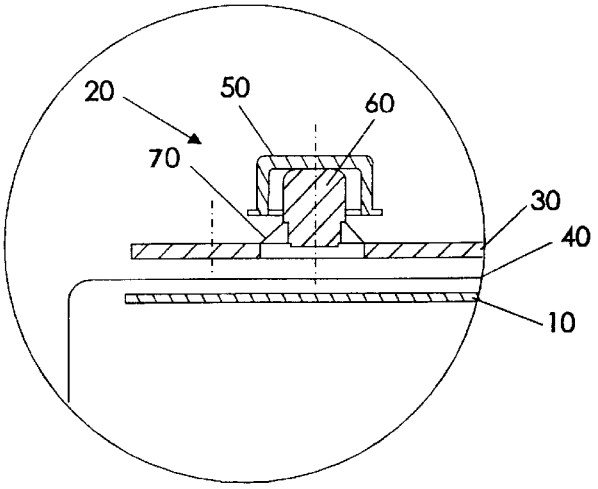
FIG. 3 shows an enlargement of the keys of the security keyboard of FIG. 2.

FIG. 3 shows an enlargement of one of the plurality of keys 20. Each of the plurality of keys 20 has a key top 50 and a keyboard plunger 60. The keyboard plunger 60 is retained by means of a bearing 70 in the switching foil 30. Both the keyboard plunger 60 and the switching foil 30 consist of relatively soft material, preferably a silicone compound. The key top 50 on the other hand, may be made of a more rigid material and protects the security keyboard from increased wear.

The effect of the force of the key 20 on the contacting means 10 is effected by operating the key 20 through the relatively elastic keyboard plunger 60 in conjunction with the bearing 70 of the switching foil 30. Through the action of this relatively elastic force the wear on the security film 40 in the region of the keyboard plunger 60 is minimized.

Figure 4:
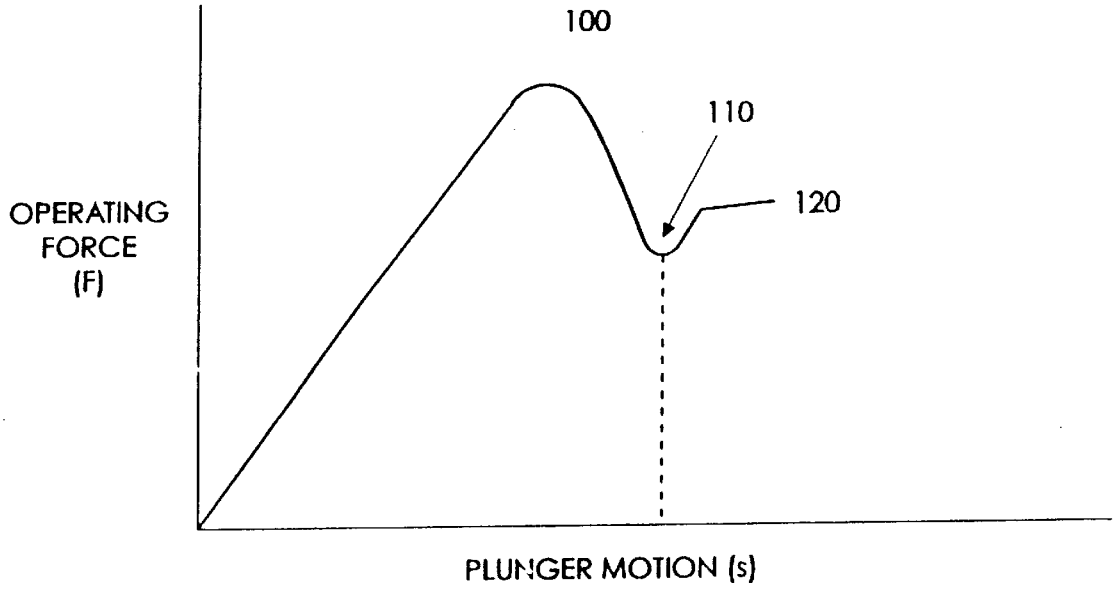
FIG. 4 depicts a graph of the curve for the operating force on the contacting means of the keys of FIG. 3 during the pressing of a key, in relation to the deferred movement of the keyboard plunger.

The keyboard plunger 60 is itself carried in a slightly elastic fashion by the bearing 70 and thus provides, when the key 20 is operated, a so-called tactile feedback. FIG. 4 shows diagrammatically the curve for an operating force acting on the contacting means 10 during the pressing of the key 20 in relation to the path traversed by the keyboard plunger 60. After overcoming a maximal pressure point 100, there is a continuous fall in the operating pressure until the keyboard plunger 60 comes into contact with the security film 40 at a pressure inflection point 110. After passing the pressure inflection point 110 the operating pressure again rises with the movement of the plunger, since now both the security film 40 and also the contacting means 10 counteract the effect of the force. At a switching point 120 the switch is closed.

In operating the key 20 the operating force first increases for the user of the key 20 to a maximal pressure point 100, after which there is a fall in the operating force to the point of inflection 110, followed by a slighter, shorter rise to the switching point 120. During operation, the key 20 'overcomes' the force countering the movement of the key at the maximal pressure point 100 resulting, because of inertia, in a positive attainment of the switching point 120. As long as the forces at the point of inflection 110 and the switching point 120 are considerably lower than the maximal operating force at the pressure point 100, the keyboard is 'user-friendly', since 'overpressing' is not required to achieve closure of the contact. The so-called 'tactile feedback' on operating the key 20 thus permits positive switching of the corresponding switch in the contacting means 10.

The tactile feedback means that, after reaching the maximal operating force at the maximal pressure point 100, it falls again and this is noticed and felt by the operator of the key 20. This suggests to the operator that the contacts are closed and that the operation can be discontinued. The tactile feedback thus provides a 'comfortable switching sensation' in operating the keys 20.

Because of the inertia of the finger or the travel, the switch point 120 is 'automatically' achieved, so long as this is considerably lower than the maximal pressure point 100.

The path of the force curve shown in FIG. 4 with an 'automatic feedback' is preferably achieved by designing the switching foil 30 as an elastic silicone mat. Correspondingly, the elastic security film 40 can be made adequately thin, since the elastic silicone mat exerts only a slight mechanical load on the security film 40. Up to the point of inflection 110, the characteristic curve is primarily defined by the silicone mat, but from the point of inflection 110, the force curve is primarily determined by the silicone mat, the security film (e.g. an intrusion detection screen) and possibly other security films.

While the invention has been particularly shown and described with reference to a preferred embodiment, it will be understood that various changes in form and detail may be made therein without departing from the spirit and scope of the invention.

What is claimed is:

1. A security keyboard, comprising:

a contacting means including electrical contact elements;

a thin and elastic security film substantially completely enveloping the contacting means to secure the contacting means against unauthorized access, said security film including an intrusion detection screen with a meander shaped resistance network of thin meandering conductor paths;

a switching foil adjacent the security film and including a plurality of bearings, said switching foil consisting of a relatively soft and elastic material; and a plurality of keys carried in the switching foil, each key including a keyboard plunger consisting of a relatively soft and elastic material, and each key further including a key top consisting of a rigid material, with each keyboard plunger being held elastically in a bearing of the switching foil, wherein action of a force applied to a key of the plurality of keys is effected through the keyboard plunger in combination with the bearing in the switching foil and is conveyed through the security film to the contact elements of the contacting means, wherein the operation of a key of the plurality of keys produces an operating force acting on the contacting means producing a tactile feedback that on exceeding a maximal actuating force at a maximal pressure point results in a continuous decrease in the operating force to a pressure inflection point and after passing the pressure inflection point the operating force again increases up to a force that is considerably lower than the maximal actuating force at a switching point at which the electrical contact elements are closed.

* * * * *